US008391769B2

(12) United States Patent
Kitagawa

(10) Patent No.: US 8,391,769 B2
(45) Date of Patent: Mar. 5, 2013

(54) TONER-LEVELING MECHANISM, PHOTO-CONDUCTOR UNIT, AND IMAGE-FORMING APPARATUS

(75) Inventor: Yusuke Kitagawa, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 217 days.

(21) Appl. No.: 12/892,623

(22) Filed: Sep. 28, 2010

(65) Prior Publication Data

US 2011/0182640 A1 Jul. 28, 2011

(30) Foreign Application Priority Data

Jan. 28, 2010 (JP) ..... 2010-016644

(51) Int. Cl.
*G03G 21/12* (2006.01)

(52) U.S. Cl. ..... 399/360

(58) Field of Classification Search ..... 399/358, 399/360, 120, 123, 119
See application file for complete search history.

(56) References Cited

U.S. PATENT DOCUMENTS 5,084,734 A * 1/1992 Yoshino et al. ..... 399/262
2008/0124157 A1 5/2008 Nakano et al.
2008/0260441 A1* 10/2008 Takagi et al. ..... 399/360

FOREIGN PATENT DOCUMENTS

JP 11-038852 A 2/1999
JP 2008-129513 A 6/2008

* cited by examiner

*Primary Examiner* — David Gray
*Assistant Examiner* — Sevan A Aydin
(74) *Attorney, Agent, or Firm* — Sughrue Mion, PLLC

(57) ABSTRACT

A toner-leveling mechanism installed and operative in a housing chamber that houses toner, the toner-leveling mechanism being capable of leveling toner accumulated in the housing chamber and narrowing an operation space of the toner-leveling mechanism in accordance with an increase in an accumulated amount of the toner.

10 Claims, 10 Drawing Sheets

TONER-LEVELING MECHANISM, PHOTO-CONDUCTOR UNIT, AND IMAGE-FORMING APPARATUS

CROSS-REFERENCE TO RELATED APPLICATIONS

This application is based on and claims priority under 35 U.S.C. 119 from Japanese Patent Application No. 2010-016644, which was filed on Jan. 28, 2010.

TECHNICAL FIELD

The present invention relates to a toner-leveling mechanism, a photo conductor unit, and an image-forming apparatus.

RELATED ART

In image-forming apparatuses such as laser printers, a method is employed in which, after a toner image is formed by attaching toner to a photo conductor drum where an electrostatic latent image has been formed, the formed toner image is transferred by a transfer roller onto a recording sheet. It is desirable that such an image-forming apparatus has a capability to remove toner remaining on the photo conductor drum and to house effectively large quantities of the removed toner in a vessel. Therefore, technologies to house effectively large quantities of toner removed from the photo conductor drum in a vessel have been invented.

SUMMARY

According to an aspect of the present invention, there is provided a toner-leveling mechanism installed and operative in a housing chamber that houses toner, the toner-leveling mechanism being capable of leveling toner accumulated in the housing chamber and narrowing an operation space of the toner-leveling mechanism in accordance with an increase in an accumulated amount of the toner.

BRIEF DESCRIPTION OF THE DRAWINGS

Exemplary embodiments of the present invention will be described in detail based on the following figures, wherein.

DETAILED DESCRIPTION

Figure 1:
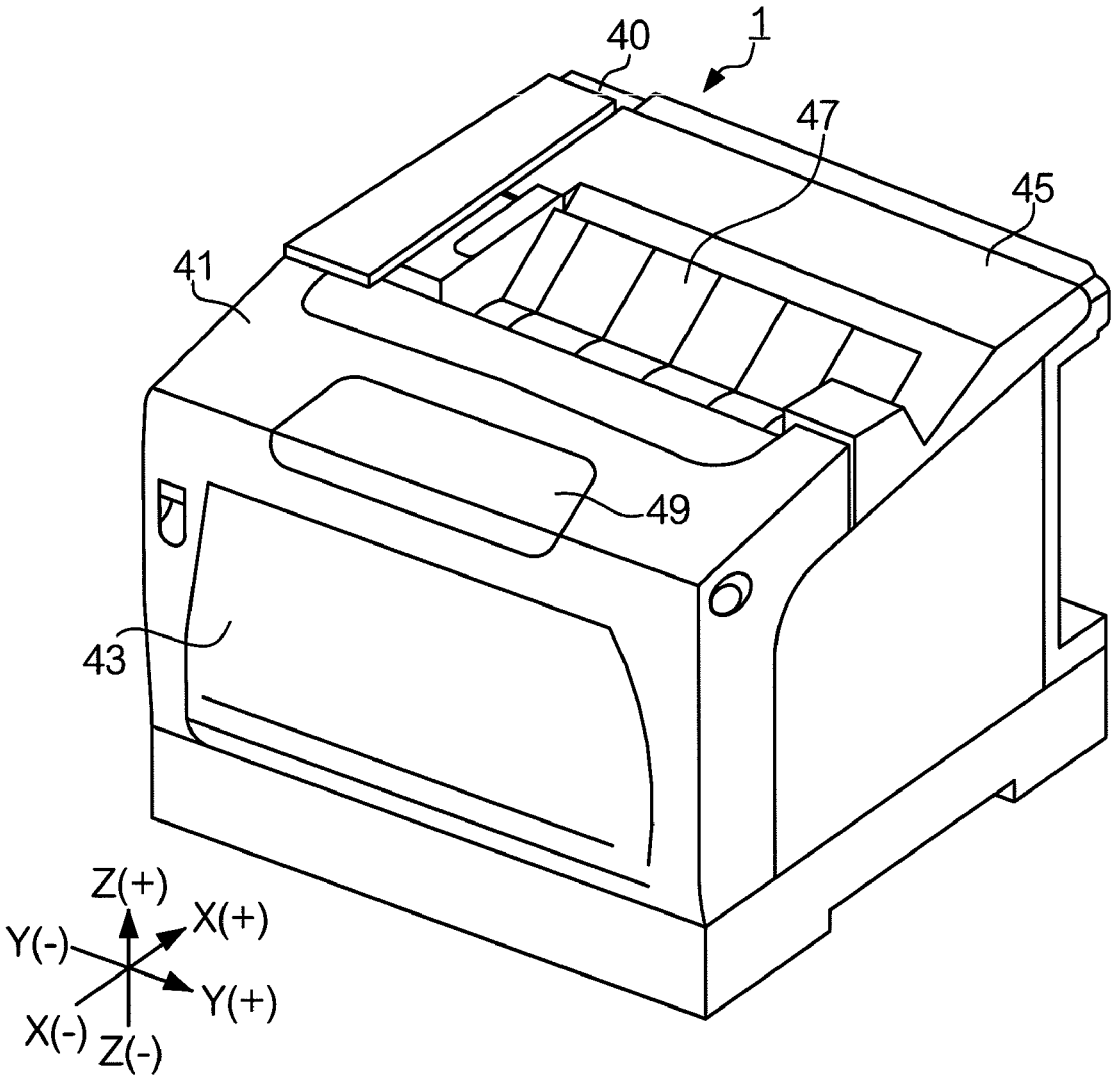
FIG. 1 shows an external view of an image-forming apparatus.

An exemplary embodiment of the present invention will be described hereinafter. As an example, an image-forming apparatus, such as a printer or a copying machine, has an opening/closing cover on the top face or the side face of the chassis thereof for maintenance and replacement of components or for operations to fix problems such as recording paper jamming. In this exemplary embodiment, description will be made about such an image-forming apparatus as an example. FIG. 1 is a schematic view showing a structure of an image-forming apparatus according to this exemplary embodiment. In the following, description is given of image-forming apparatus 1 as viewed from the front of the apparatus, where the horizontal direction is denoted as the Y-axis direction, with right/left directions from a viewer's perspective being indicated by Y(+) and Y(−), respectively; the front-back direction of image-forming apparatus 1 is denoted as the X-axis direction, with back/front directions of image-forming apparatus 1 being indicated by X(+) and X(−), respectively; and the vertical direction is denoted as the Z-axis direction, with up/down directions being indicated by Z(+) and Z(−), respectively.

FIG. 1 shows an external view of an image-forming apparatus 1. Apparatus body 40 of image-forming apparatus 1 is provided with front opening/closing cover 41. In addition, front opening/closing cover 41 is provided with feed opening/closing cover 43. Feed opening/closing cover 43 is usually closed relative to front opening/closing cover 41, but when types of recording sheets other than those of recording sheets stocked in paper container 24 are required, feed opening/closing cover 43 is opened relative to front opening/closing cover 41, and necessary recording sheets are fed through feed opening/closing cover 43. Although front opening/closing cover 41 is usually opened when cover 45 is opened, FIG. 1 shows front opening/closing cover 41 in a state of being closed for convenience of description. In addition, cover 45 is openably and closably provided on a top surface of apparatus body 40. Recording sheets 18 on which toner images are formed are discharged to a top surface of cover 45. Operation section 49 is provided on the top surface of apparatus body 40. Operation section 49 has operation buttons for configuring various settings for image-forming apparatus 1.

Figure 2:
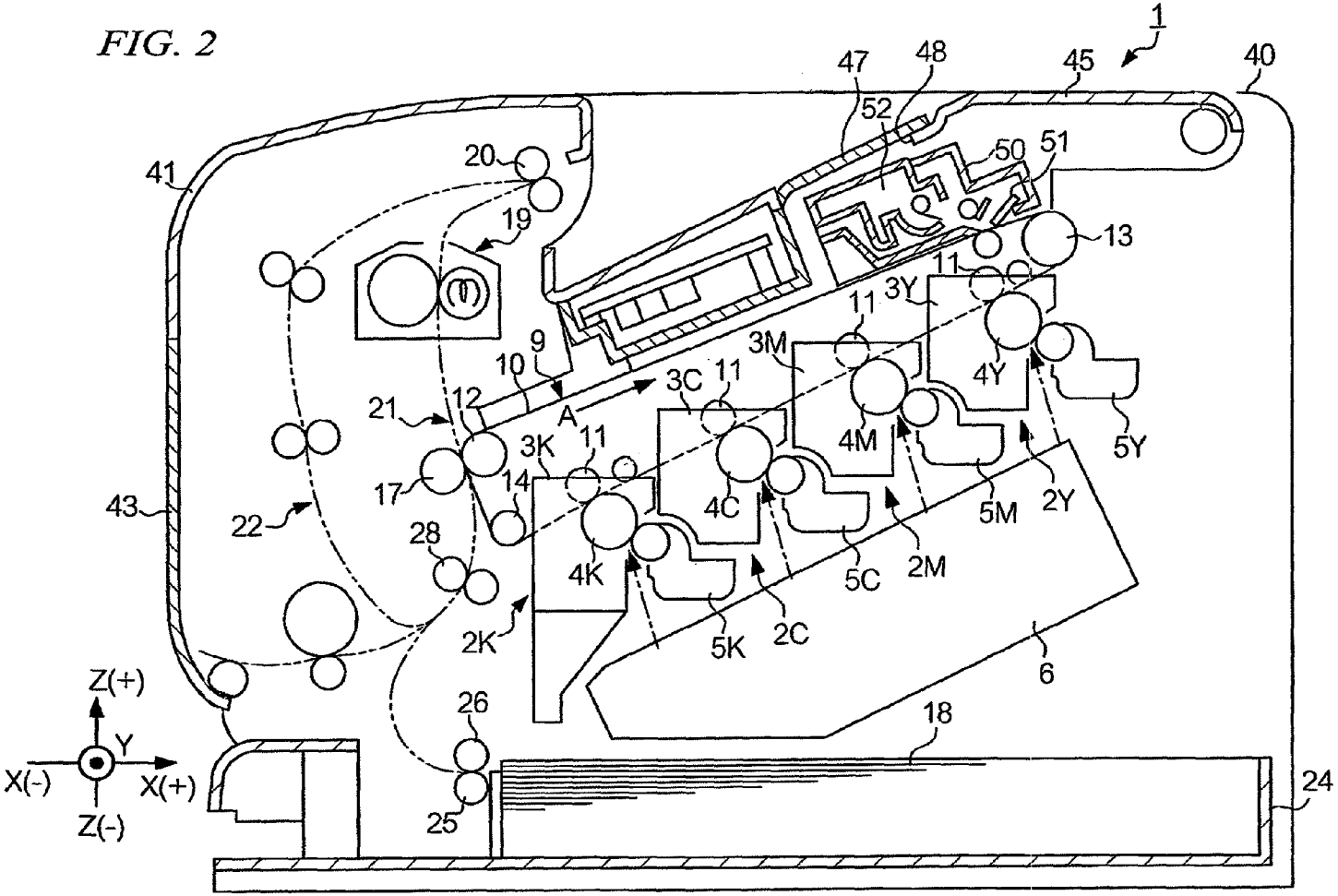
FIG. 2 shows an internal configuration of the image-forming apparatus.

FIG. 2 shows an internal configuration of image-forming apparatus 1. Image-forming apparatus 1 is a tandem full-color printer in which image forming units 2 are disposed in parallel along intermediate transfer belt 10. Provided inside image-forming apparatus 1 are four image forming units, 2Y for yellow (Y), 2M for magenta (M), 2C for cyan (C), and 2K for black (K), as well as a scanner and a personal computer (which are not shown in the figure), or an image-processing device (not shown) for performing image processing on image data sent through a telephone line and the like.

Image-forming units 2Y, 2M, 2C, and 2K are arranged in parallel with fixed spaces therebetween in such a way that image forming unit 2Y for yellow (Y), which is firstly transferred onto the intermediate transfer belt 10, is disposed at the highest position and image forming unit 2K for black (K), which is lastly transferred onto the intermediate transfer belt 10, is disposed at the lowest position. In other words, they are disposed on a slant forming an angle relative to the horizontal. As a result of these four image-forming units 2Y, 2M, 2C, and 2K being disposed on such a slant, the distance between the image forming unit 2Y and the image forming unit 2K along the width of the image-forming apparatus 1 (in the direction X) is shorter than that in the case where these four image forming units 2Y, 2M, 2C, and 2K are disposed horizontally.

The four image-forming units 2Y, 2M, 2C, and 2K have basically the same structure, and therefore, in the following description, they will be referred to as image-forming unit 2, when it is not necessary to distinguish between them. Image-forming unit 2 includes a photo conductor unit 3 that is equipped with a photoconductor drum 4 serving as an image-holding body, a charging device and the like, and a developing device 5. The photoconductor unit 3 is removable from the apparatus body 40, and the developing device 5 is fixed to the apparatus body 40 through a frame (not shown).

An image exposing device 6 that is commonly used for image forming units 2Y, 2M, 2C, and 2K is provided under image forming units 2Y, 2M, 2C, and 2K. This image exposing device 6 is equipped with four semiconductor lasers (not shown) that irradiate laser beams individually modulated in accordance with image data of Y, M, C, and K colors. The four laser beams irradiated from these semiconductor lasers are polarized by polygon mirrors, and through lenses and mirrors (none of which are shown), they scan surfaces of photo conductor drums 4 of image forming units 2Y, 2M, 2C, and 2K respectively, and write electrostatic latent images onto the surfaces. The electrostatic latent images written onto the surfaces of photo conductor drums 4 are developed by the use of developers including corresponding color toners by developing devices 5Y, 5M, 5C, and 5K, with the result that four toner images are generated. The four color toner images that are sequentially generated on the photo conductor drums 4 of image forming units 2Y, 2M, 2C, and 2K are overlappingly transferred by corresponding first transfer rollers 11 onto intermediate transfer belt 10 that is disposed over image forming units 2Y, 2M, 2C, and 2K as an intermediate transfer body.

Intermediate transfer belt 10 is an endless belt member that is set up by plural rollers such as drive roller 12, tension roller 13, and idler roller 14. Intermediate transfer belt 10 is driven in the direction indicated by arrow A by drive roller 12 that is rotationally driven by a drive motor (not shown). This intermediate transfer belt 10 is disposed on a slant forming a certain angle relative to the horizontal in such a way that, on the lower base of intermediate transfer belt 10, the downstream side in the direction of travel of intermediate transfer belt 10 is lower, and the upstream side is higher. In the above-mentioned lower base, intermediate transfer belt 10 makes contact with photo conductor drums 4Y, 4M, 4C, and 4K of image forming units 2Y, 2M, 2C, and 2K. Intermediate transfer belt 10, first transfer rollers 11, drive roller 12, tension roller 13, idler roller 14, and the like constitute intermediate transfer unit 9.

Recording sheets 18 of a recognized standard size and quality are fed as recording media from paper container 24 disposed inside image-forming apparatus 1 along feeding route 21 formed by plural pairs of rollers. Along this feeding route 21, recording sheets 18 from paper container 24 are fed to resist roller 28 one by one by sheet-feeding roller 25 and sheet-separating/feeding roller 26, and they stop moving once at resist roller 28. Next, these recording sheets 18 are fed to a second transfer position of intermediate transfer belt 10 by resist roller 28 that is rotationally driven at a predetermined timing. At the second transfer position there is provided second transfer roller 17, disposed so as to contact with the surface of intermediate transfer belt 10. Toner images of yellow (Y), magenta (M), cyan (C), and black (K) provided in overlapping relation on intermediate transfer belt 10 are transferred onto recording sheet 18 under pressure of secondary transfer roller 17 and action of electrostatic force. After heat and pressure are applied to recording sheets 18, onto which the four color toner images have been transferred through the second transfer, by fixing device 19 as a fixing process, the recording sheets are discharged by discharge roller 20 to the top surface of cover 45. In addition, feeding route 21 is provided with reversal mechanism 22 that turns over recording sheets 18 so as to reverse the obverse and the reverse sides of recording sheets 18.

Cover 45 is provided with sub-cover 47 that is openable and closable. This sub-cover 47 is openable and closable independently of cover 45, and even if cover 45 is closed relative to apparatus body 40, opening 48 formed on cover 45 can be opened. Sub-cover 47 is opened when all or part of toner recovery unit 50 is mounted on or removed from apparatus body 40.

Toner recovery unit 50 is installed on the downstream side in the direction of travel of intermediate transfer belt 10 on the upper base of intermediate transfer belt 10 and in the upward direction of gravitational force (in the direction Z(+)). As a result, toner recovery unit 50 is disposed nearer to tension roller 13 than to drive roller 12. This toner recovery unit 50 includes: cleaning member 51 serving as a removing section that has contact with the surface of intermediate transfer belt 10 and scratches the surface of intermediate transfer belt 10 to remove toner remaining attached to the surface; and recovery chamber 52 serving as a recovery section that recovers the removed toner. All or part of toner recovery unit 50 can be mounted or removed through opening 48 formed on cover 45 when sub-cover 47 is opened.

Intermediate transfer unit 9 and toner recovery unit 50 are mounted on cover 45, and second transfer roller 17 is mounted on apparatus body 40. As is described above, intermediate transfer belt 10 is disposed on a slant in such a way that tension roller 13 is positioned higher, in terms of the direction of gravitational force (Z(+) side) than drive roller 12, so that, in toner recovery unit 50, recovery chamber 52 is positioned lower, in terms of the direction of gravitational force, than cleaning member 51.

Figure 3:
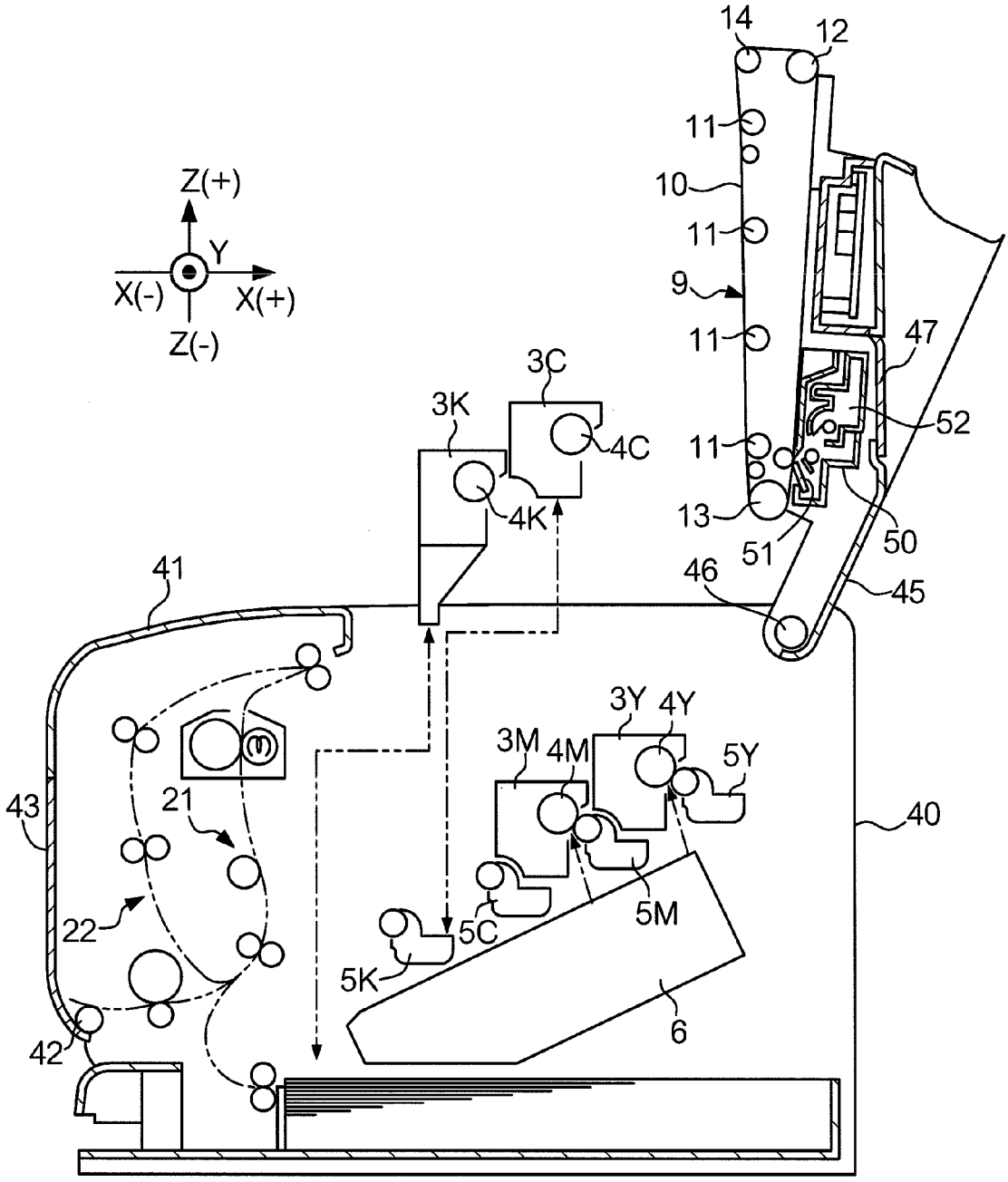
FIG. 3 shows an internal state of the image-forming apparatus with a cover opened.

FIG. 3 shows an internal state of image-forming apparatus 1 with cover 45 opened. Cover 45 is usually closed relative to apparatus body 40, and it is opened when photo conductor unit 3Y, 3M, 3C, or 3K is mounted on or removed from apparatus body 40. To prevent intermediate transfer unit 9 installed inside cover 45 from banging against front opening/closing cover 41 when cover 45 is opened, front opening/closing cover 41 is opened first relative to apparatus body 40 before cover 45 is opened. On the other hand, before front opening/closing cover 41 is closed relative to apparatus body 40, cover 45 is closed first relative to apparatus body 40.

Figure 4:
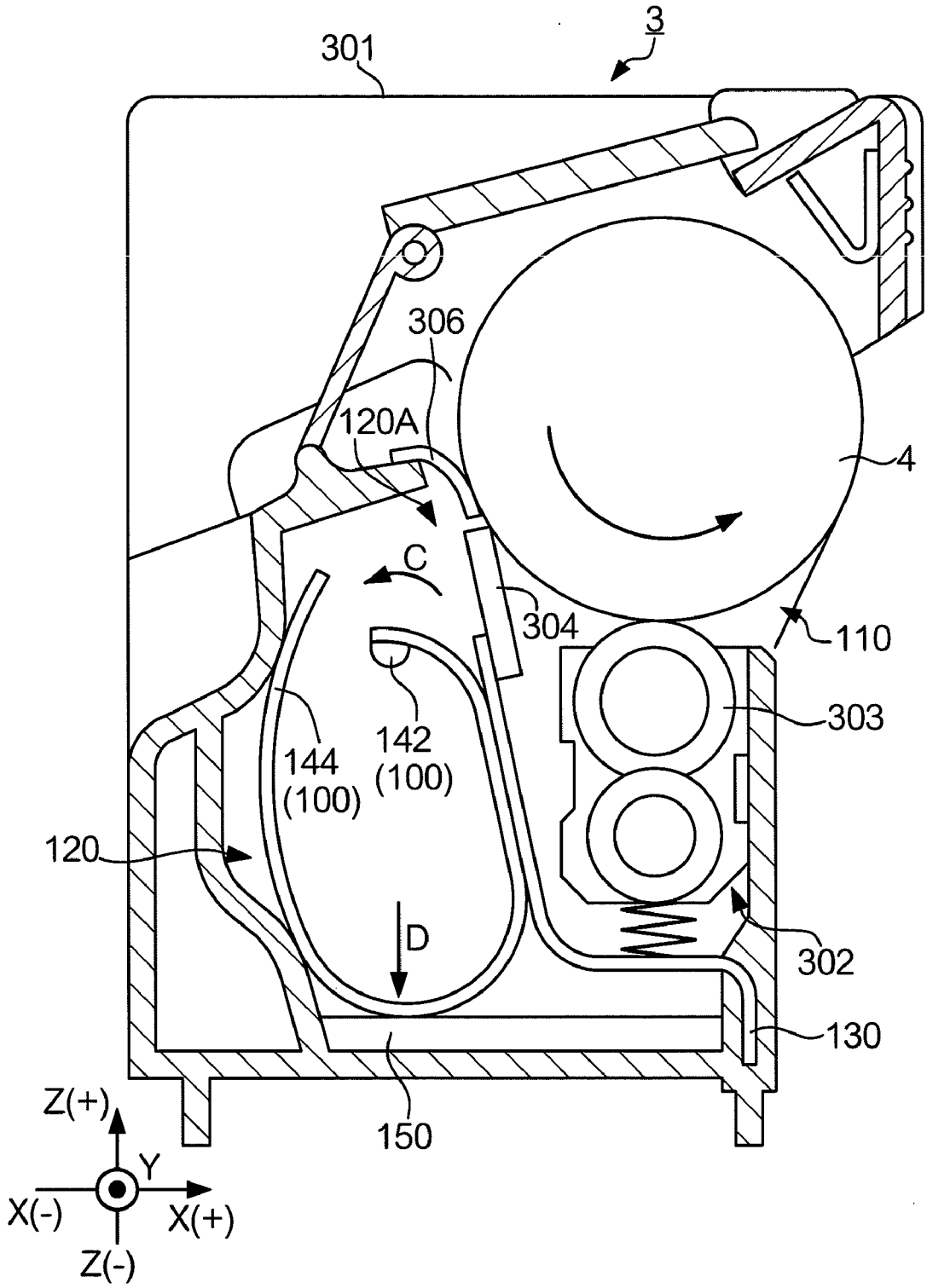
FIG. 4 shows a cross-section of a photo conductor unit.
Figure 5A:
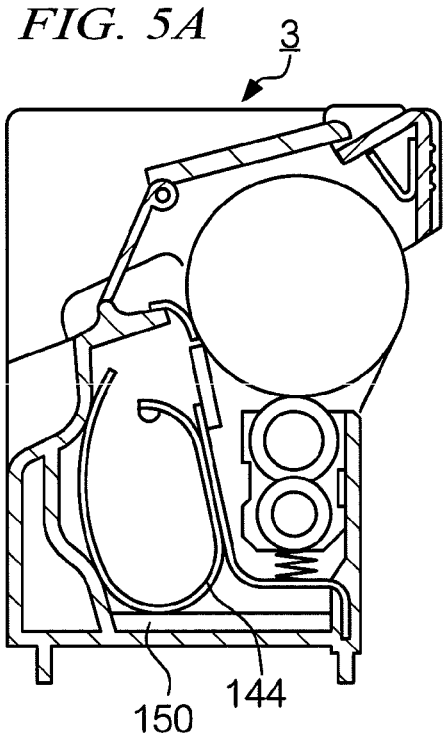
FIG. 5A to FIG. 5D show operations of a toner-leveling mechanism in the case where an accumulated amount of toner is less than in the cases of FIG. 6A to FIG. 6D and FIG. 7A to FIG. 7D.
Figure 5B:
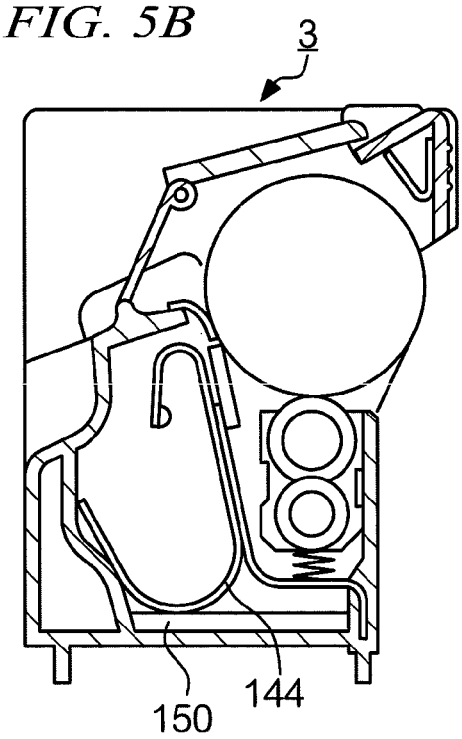
Figure 5C:
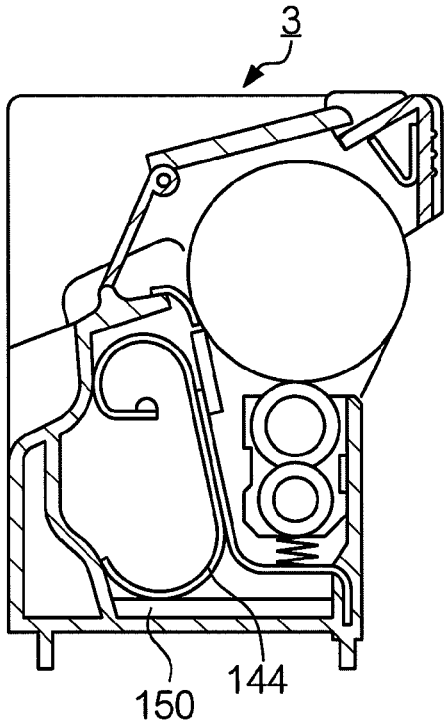
Figure 5D:
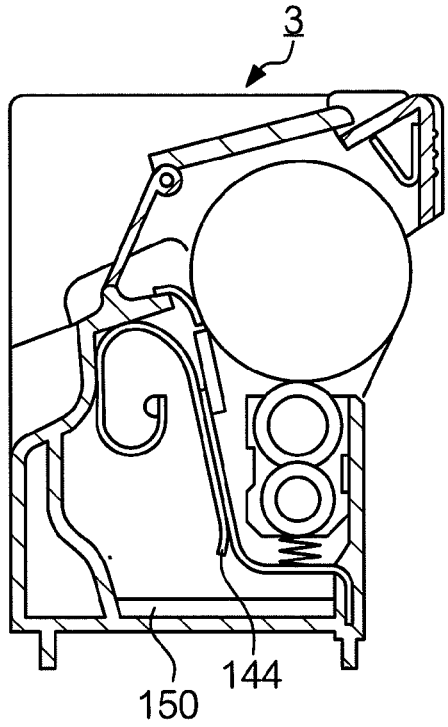
Figure 6A:
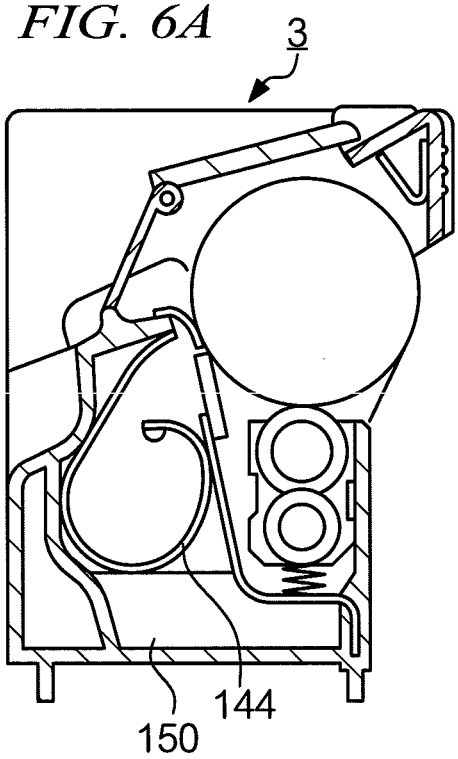
FIG. 6A to FIG. 6D show operations of the toner-leveling mechanism in the case where an accumulated amount of toner is more than in the case shown in FIG. 5A to FIG. 5D and less than in the case shown in FIG. 7A to FIG. 7D.
Figure 6B:
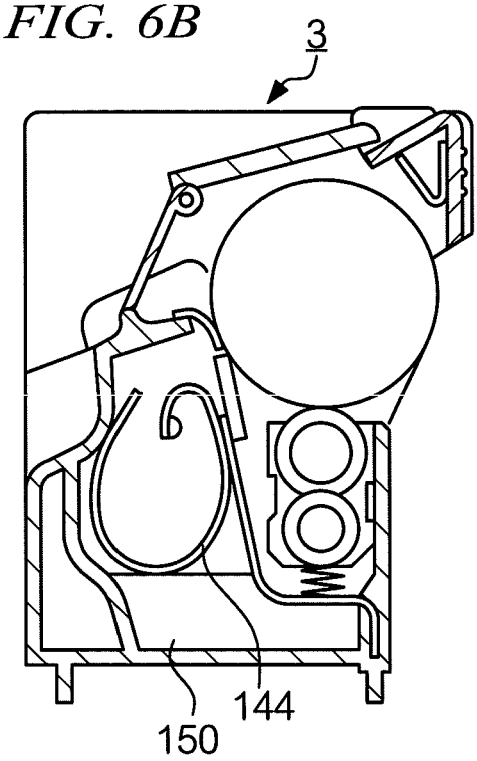
Figure 6C:
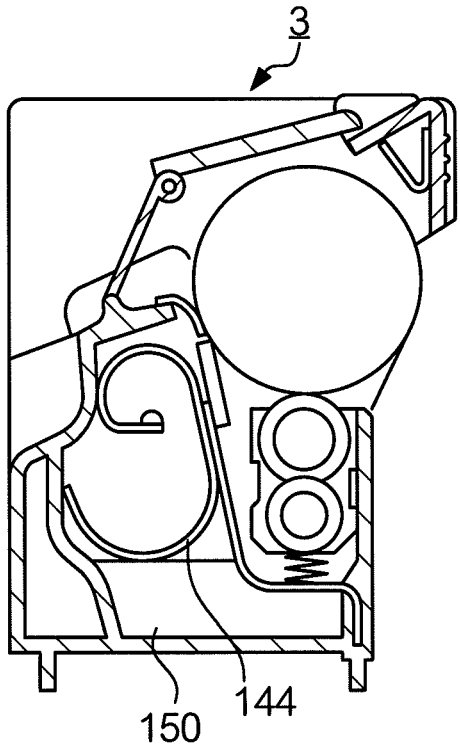
Figure 6D:
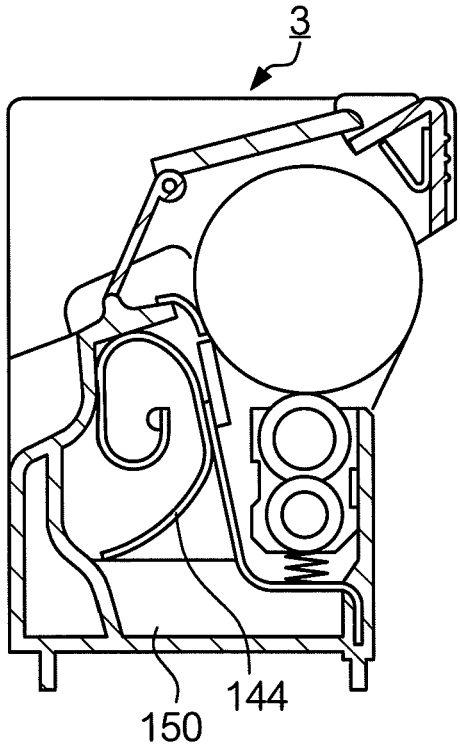
Figure 7A:
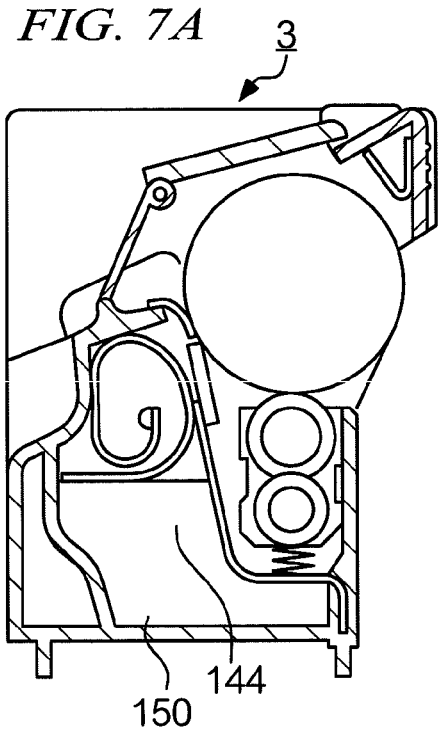
FIG. 7A to FIG. 7D show operations of the toner-leveling mechanism in the case where an accumulated amount of toner is more than in the cases shown in FIG. 5A to FIG. 5D and FIG. 6A to FIG. 6D.
Figure 7B:
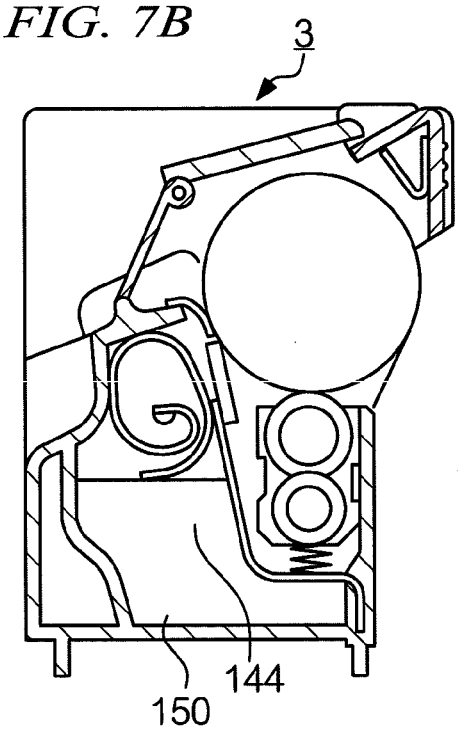
Figure 7C:
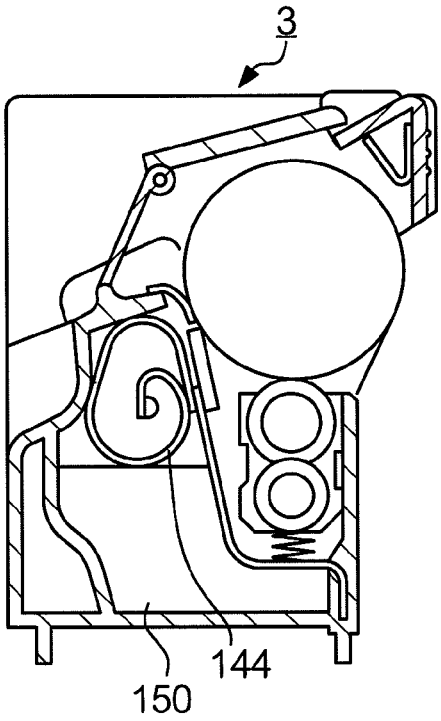
Figure 7D:
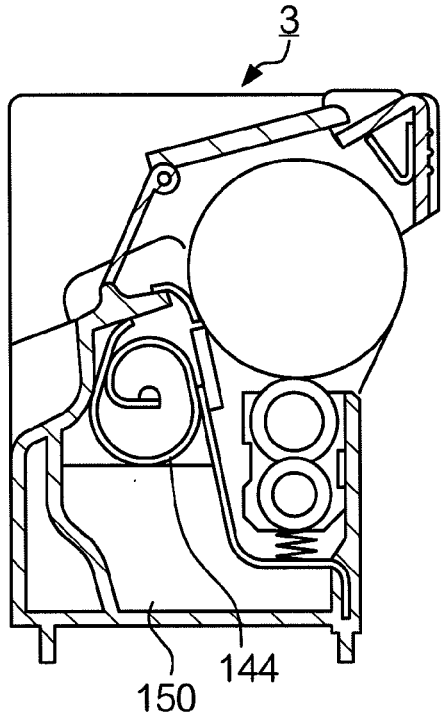

FIG. 4 shows a cross-section of photo conductor unit 3. Photo conductor unit 3 includes photo conductor unit body 301 that constitutes the outer shape of photo conductor unit 3. Prepared in the internal space of photo conductor unit body 301 is supporting plate 130. Supporting plate 130 is a plate-like member the direction of whose long side coincides with the direction of the rotating shaft of photo-conductive drum 4 (direction Y). Supporting plate 130 is prepared partly because it supports cleaning member 304 at its tip. The internal space of photo conductor unit body 301 is divided into first housing chamber 110 and second housing chamber 120 by supporting plate 130. In other words, supporting plate 130 functions as a wall portion of second housing chamber 120. Described concretely, supporting plate 130 is installed on the lower part of a border between first housing chamber 110 and second housing chamber 120 to block the passage through the lower part of the border. Formed at the upper part of the border between first housing chamber 110 and second housing chamber 120, that is, at the upper part of supporting plate 130 is opening 120A used for taking toner from first housing chamber 110 into second housing chamber 120. The size of opening 120A is the minimum size required for toner to be taken into second housing chamber 120, and the remaining space is filled by occluding member 306.

Photo conductor drum 4 and charging device 302 are housed in first housing chamber 110. Charging device 302 has charging roller 303. Charging roller 303 uniformly charges the surface of photo conductor drum 4 when photo conductor drum 4 rotates. Because the surface of photo conductor drum 4 is evenly charged in this way, electrostatic latent images are successfully written onto the surface of photo conductor drum 4 by the laser beams irradiated from image exposing device 6 shown in FIG. 2. These electrostatic latent images are developed by developing devices 5 shown in FIG. 2, with the result that toner images are formed. These toner images are transferred onto intermediate transfer belt 10 by first transfer roller 11 shown in FIG. 2.

Second housing chamber 120 houses toner removed from photo conductor drum 4 ("one of the physical objects" of the present invention). Cleaning member 304 is fixed at the tip of supporting plate 130. Therefore, part of opening 120A is covered by cleaning member 304. Cleaning member 304 is a plate-like member the direction of whose long side coincides with the direction of the rotating shaft of photo-conductive drum 4 (direction Y), and the edge of cleaning member 304 has contact with the surface of photo-conductive drum 4. Cleaning member 304 scratches the surface of photo conductor drum 4 to remove toner remaining attached thereto when the photo conductor drum 4 rotates. The toner removed by cleaning member 304 is taken into second housing chamber 120 through opening 120A, and is accumulated in second housing chamber 120.

Second housing chamber 120 is provided with toner-leveling mechanism 100. Toner-leveling mechanism 100 is operative in second housing chamber 120 to level the toner accumulated in second housing chamber 120 (referred to as toner 150 hereinafter). Toner-leveling mechanism 100 is configured to narrow its operation space in accordance with the increase in the accumulated amount of toner 150. The operation space of toner-leveling mechanism 100 is a space in which toner-leveling mechanism 100 is operable to level toner 150. Described concretely, as the accumulated amount of toner 150 increases, the open space of second housing chamber 120 is decreased. Accordingly, toner-leveling mechanism 100 narrows its operation space to operate suitably in accordance with the decreased open space of second housing chamber 120. As a result, toner-leveling mechanism 100 operates in such a way that it suppresses a load it receives from toner 150 when the accumulated amount of toner 150 increases. Therefore, toner-leveling mechanism 100 can effectively level toner 150, with the result that toner-leveling mechanism 100 can facilitate effective housing of the toner removed from photo conductor drum 4 in second housing chamber 120.

Toner-leveling mechanism 100 according to the exemplary embodiment of the present invention includes rotating shaft 142 and sheet member 144. Both ends of rotating shaft 142 are supported at bearings formed in photo conductor unit body 301. Rotating shaft 142 is configured in such a way that the axial direction of rotating shaft 142 is parallel to the direction of the rotating shaft of photo conductor drum 4 (the direction Y). Rotating shaft 142 rotates in conjunction with the rotation of photo conductor drum 4 through a driving mechanism (not shown) having a gear, a pulley, and a belt, and the direction of rotation of rotating shaft 142 is, as shown by an arrow C, opposite to the direction of the rotation of photo conductor drum 4.

Sheet member 144 extends from a peripheral surface of rotating shaft 142 in the circumferential direction of rotating shaft 142. Sheet member 144 has a constant width along the axial direction of rotation shaft 142 (direction Y). In addition, sheet member 144 has a fixed portion attached to the peripheral surface of rotating shaft 142. Described concretely, the edge of the fixed portion of sheet member 144 is bonded to the planar part formed on rotating shaft 142 by an adhesive. Sheet member 144 has a certain length along the direction in which the sheet member extends. In addition, sheet member 144 has flexibility. Sheet member 144, which is in the state of being curved because it is reeled by rotating shaft 142, is housed in second housing chamber 120. Because sheet member 144 has flexibility, sheet member 144 will revert to the state of being flat from the state of being curved. Therefore, while an outer surface of sheet member 144 makes contact with the wall portion of second housing chamber 120, it presses the wall portion of second housing chamber 120 with an appropriate amount of pressure. As described above, extending from rotating shaft 142 along the wall portion of second housing chamber 120 in the state of being curved and pressing the wall portion of second housing chamber 120 with an appropriate amount of pressure, sheet member 144 is housed in second housing chamber 120.

In toner-leveling mechanism 100 configured as described above, in accordance with the rotation of rotating shaft 142, the outer surface of sheet member 144 moves rotationally with rotating shaft 142 as a rotation center in the free space of second housing chamber 120 while making contact with the wall portion of second housing chamber 120, and pressing the wall with an appropriate amount of pressure. Second housing chamber 120 has some different spaces in terms of both shape and volume. For example, as shown in FIG. 4, a space spreading in the upper direction of gravitational force (direction Z(+)) is larger than a space spreading in the direction of rotating shaft 142 (direction Y), and a space spreading in the lower direction of gravitational force (direction Z(−)) is larger than the space spreading in the upper direction of gravitational force (direction Z(+)). Because of its flexibility and elasticity, sheet member 144 curves its shape along the wall portion of second housing chamber 120 in accordance with the shapes and volumes of the spaces in second housing chamber 120. As a result, sheet member 144 moves rotationally with rotating shaft 142 as a rotation center in the spaces of second housing chamber 120 while changing its shape in accordance with the shapes and volumes of the spaces in second housing chamber 120. In a base portion of second housing chamber 120 where toner 150 is accumulated, sheet member 144 moves in such a way that its outer surface slides across the surface of toner 150 while making contact with the surface of toner 150 and pressing toner 150 downward (in the direction Z(−)). Therefore, toner-leveling mechanism 100 can effectively level toner 150, with the result that toner-leveling mechanism 100 can facilitate effective housing of the toner removed from photo conductor drum 4 in second housing chamber 120.

Sheet member 144 has a convexly curved portion toward the bottom of second housing chamber 120 (in the direction Z(−)). Described concretely, one point of sheet member 144 nearer to the fixed portion makes contact with a front wall portion located in front of rotation shaft 142 (in the direction X(+)), another point nearer to the free end makes contact with a rear wall portion located in the rear of rotation shaft 142 (in the direction X(−)), and there is a portion of sheet member 144 of a certain length, which is convexly curved toward the bottom of second housing chamber 120 (in the direction Z(−)), between the above two points. Specifically, the above-mentioned certain length is a length longer than half the circumferential length of a circle that has a diameter length W between the above two points.

Sheet member 144 levels the surface of toner 150 using the outer surface of its convexly curved portion. In addition, the outer surface of the convexly curved portion of sheet member 144 has a certain amount of tension owing to the repulsive force of sheet member 144. As a result, sheet member 144 presses the surface of toner 150 with a certain amount of pressure using the outer surface of its convexly curved portion. Especially, sheet member 144 has the highest pressure near a top of its convexly curved portion. Sheet member 144 according to the exemplary embodiment of the present invention uses this top to press toner 150 accumulated in the second housing chamber. Therefore, sheet member 144 effectively levels toner 150 using this highest pressure. As a result, toner-leveling mechanism 100 can facilitate effective housing of the toner removed from photo conductor drum 4 in second housing chamber 120.

As the length between the above two points of sheet member 144 becomes greater, the convexly curved portion of sheet member 144 goes down deeper toward the bottom of second housing chamber 120 (in the direction Z(−)). Therefore, the length between the above two points of sheet member 144 can be determined in consideration of how high the convexly curved portion of sheet member 144 is located from the bottom of second housing chamber 120. For example, FIG. 4 shows that the above two points of sheet member 144 are supported at the front and rear wall portions respectively, and that the length between these two points is sufficiently long. Therefore, the convexly curved portion of sheet member 144 reaches nearly to the bottom of second housing chamber 120. In other words, the outer surface of the top of the convexly curved portion of sheet member 144 presses the surface of toner 150 accumulated in second housing chamber 120 downward, that is, in the direction indicated by an arrow D (direction Z(−)) near of the bottom of second housing chamber 120. At the same time, beginning with the state shown in FIG. 4, sheet member 144 rotationally moves with the rotating shaft 142 as a rotation center in conjunction with the rotation of rotating shaft 142, sheet member 144 levels the surface of toner 150 by pressing toner 150 using the outer surface of the top of its convexly curved portion. As described above, even if the accumulated amount of toner 150 is small, sheet member 144 can level the surface of toner 150 by enlarging the convexly curved portion and by pressing the surface of toner 150 downward (in the direction Z(−)). In this way, toner-leveling mechanism 100 effectively levels toner 150, with the result that toner-leveling mechanism 100 can facilitate effective housing of the toner removed from photo conductor drum 4 in second housing chamber 120.

In an experiment according to this exemplary embodiment of the present invention, a polyurethane sheet 200 micrometers thick is used as sheet member 144. As a result of the experiment, it is proved that a toner-leveling mechanism employing a polyurethane sheet as sheet member 144 makes less noise than a toner-leveling mechanism employing a sheet made of any other material as sheet member 144. However, sheet member 144 is not limited to a polyurethane sheet. In addition, the thickness of sheet member 144 is not limited to 200 micrometers. The material, thickness, length, width, and the like of sheet member 144 can be appropriately determined in consideration of the shape of the second housing chamber, cost, performance of leveling toner, noise, simulation results, experiment results, and the like. For example, in order that sheet member 144 can press surface of toner 150 downward even if the accumulated amount of toner 150 is small, it is desirable that sheet member 144 be long enough that the above-mentioned two points of sheet member 144 are supported by the front and rear wall portions, the portion of the sheet member between the above two points is formed of a convexly curved shape, and the top of the convexly curved portion reaches the bottom of second housing chamber 120 when there is no toner in second housing chamber 120.

In addition, sheet member 144 extends from rotating shaft 142 in the direction opposite to the rotation direction (indicated by arrow C) of rotating shaft 142. Owing to this configuration, when rotating shaft 142 rotates, a force is applied in such a way that the force pushes the edge of the fixed portion of sheet member 144, that is, the edge of the portion of sheet member 144 bonded to the planar part of rotating shaft 142 toward the planar part, which makes it difficult for sheet member 144 to be peeled from rotating shaft 142. Here, a method of fixing sheet member 144 to rotating shaft 142 is not limited to that in which an adhesive is used.

The rotating shaft rotates in such a way that the moving direction of sheet member 144 and the direction in which the cleaning member 304 extends to its tip coincide with each other at the contact zone between sheet member 144 and cleaning member 304. Therefore, toner packing stress on the tip of cleaning member 304 can be suppressed, with the result that a stable cleaning characteristic can be obtained. In addition, because a suitable amount of toner can be fed to a tip of a blade of cleaning member 304, a phenomenon such as a blade vibration can be suppressed.

In addition, a weight can be provided to the free end of sheet member 144. For example, a rod-shaped weight that extends in the width direction (direction Y) of sheet member 144 along the edge of the free end of sheet member 144 can be fixed. If the above rod-shaped weight is prepared, because toner 150 is pressed under a high pressure owing to the weight of the weight at the free end of sheet member 144, toner 150 is effectively leveled by toner-leveling mechanism 100.

An accumulated amount of toner 150 is respectively greater in each of the operations of toner-leveling mechanism 100 shown in FIG. 5A to FIG. 5D, FIG. 6A to FIG. 6D, and FIG. 7A to FIG. 7D. FIGS. 5A to 5D show the four operating states of toner-leveling mechanism 100, in which the rotation angles of rotating shaft 142 differ from each other by 90 degrees. The same is true of FIGS. 6A to 6D, and FIGS. 7A to 7D.

As shown in FIGS. 5A to 5D, FIGS. 6A to 6D, or FIGS. 7A to 7D, the amount of sheet member 144 reeled by rotating shaft 142 increases in accordance with the increase in the accumulated amount of toner 150 in toner-leveling mechanism 100, so that the operation space of sheet member 144 in toner-leveling mechanism 100 is narrowed. Here, for the sake of explanation, it is assumed that the reeled amount of sheet member 144 according to this exemplary embodiment is defined as the entire amount of the curved portion of sheet member 144. Therefore, if there are two sheet members 144 that have the same numbers of turns around rotating shaft 142, but have different entire amounts of the curved portions, one that has a larger entire amount of the curved portion can be said to have a larger reeled amount of sheet member 144 than the other. In any of FIGS. 5A to 5D, FIGS. 6A to 6D, and FIGS. 7A to 7D, sheet member 144 has a convexly curved portion with its top turned down, regardless of the accumulated amount of toner 150, and it levels toner 150 by pressing toner 150 downward using the top of the convexly curved portion. As a result, toner-leveling mechanism 100 effectively levels toner 150. Therefore, toner-leveling mechanism 100 helps second housing chamber 120 to effectively house the toner removed from photo conductor drum 4.

Figure 8:
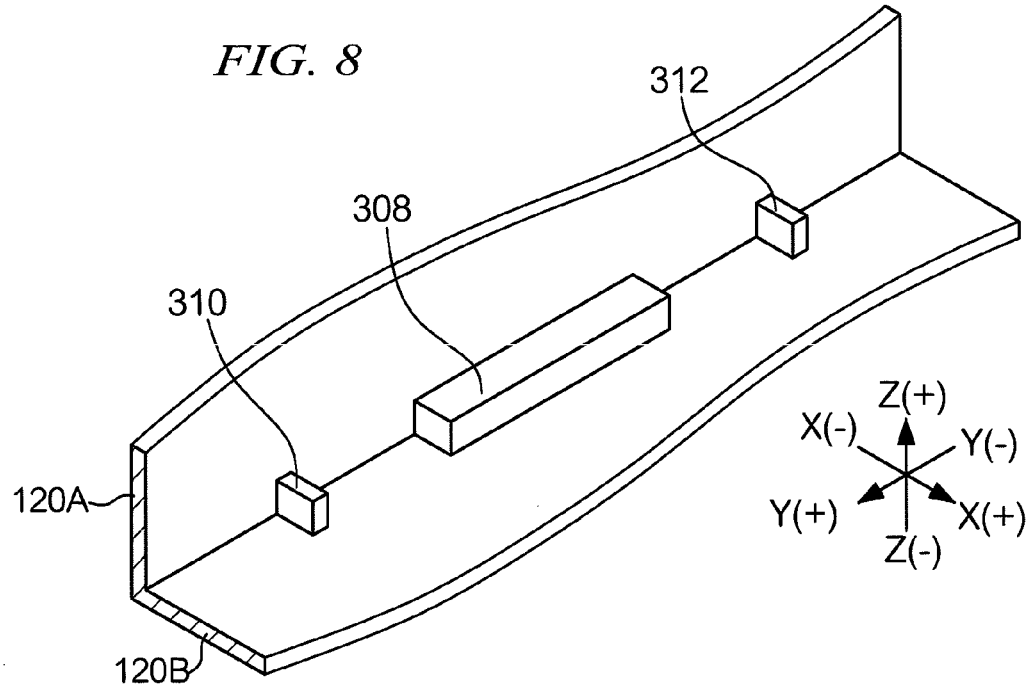
FIG. 8 shows a structure of a base portion of a second housing chamber.
Figure 9:
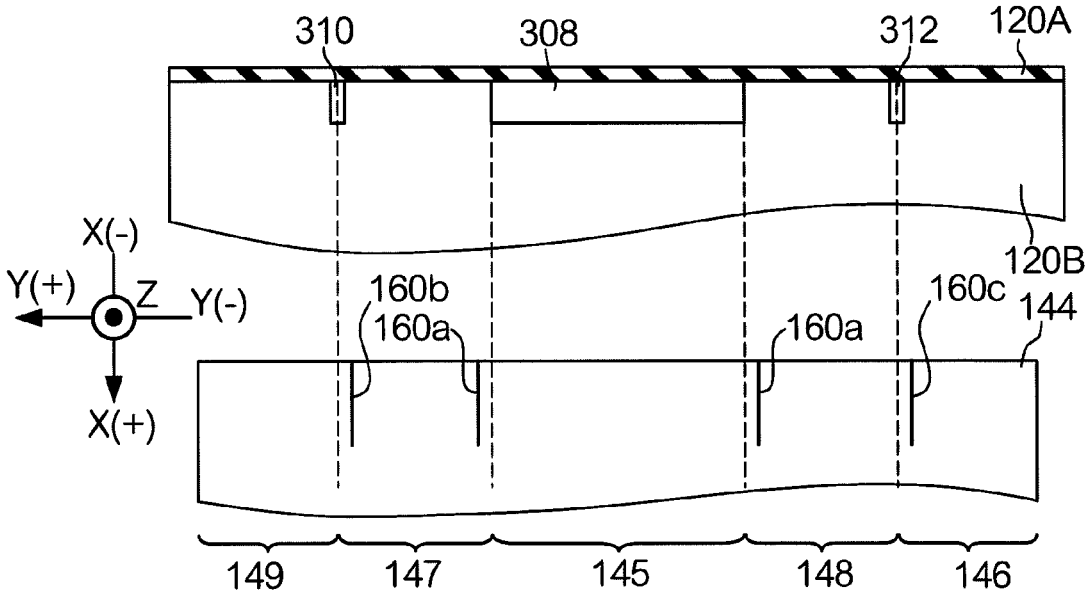
FIG. 9 shows a positional relation between a protruding portion and a slit.

FIG. 8 shows a structure of the base portion of second housing chamber 120. FIG. 9 shows a positional relation between a protruding portion and a slit. A wall 120A and a bottom 120B constitute the base portion of second housing chamber 120. Plural protruding portions (protruding portions 308, 310, and 312) are installed on the bottom of second housing chamber 120 in the width direction of the bottom of second housing chamber 120 (in the width direction of sheet member 144, that is, in the direction Y). One object of installing these protruding portions 308, 310, and 312 is to increase the strength of the bottom of second housing chamber 120.

Protruding portion 308 is installed at the center of the bottom of second housing chamber 120 in the width direction of sheet member 144, that is, in the direction Y. As shown in FIG. 9, two slits 160*a* are made at the free end of sheet member 144 in the Y direction. Specifically, one is disposed on the left side of the protruding portion 308 a little distance away from the protruding portion 308 (in the direction Y(+)), and the other is disposed on the right side of the protruding portion 308 a little distance away from the protruding portion 308 (in the direction Y(−)). As a result, first part 145 that is located between two slits 160*a*, and makes contact with protruding portion 308, second part 147 located on the left side of first part 145 (in the direction Y(+)), and third part 148 located on the right side of first part 145 (in the direction Y(−)) are formed with two slits 160*a* as boundaries at the free end of sheet member 144 in the width direction of sheet member 144 (Y direction).

Protruding portion 310 is installed on the left side of protruding portion 308 (in the direction Y(+)) in the width direction of sheet member 144, that is, in the Y direction. In response to protruding portion 310, as shown in FIG. 9, slit 160*b* is made at the free end of sheet member 144 in the Y direction. Specifically, slit 160*b* is disposed on the right side of protruding portion 310 a little distance away from protruding portion 310 (in the direction Y(−)). As a result, third part 149 located on the left side of slit 160*b* and second part 147 located on the right side of slit 160*b* are formed at the free end of sheet member 144 with slits 160*b* as a boundary.

Protruding portion 312 is installed on the right side of protruding portion 308 (in the direction Y(−)) in the width direction of sheet member 144, that is, in the Y direction. In response to protruding portion 312, as shown in FIG. 9, slit 160*c* is made at the free end of sheet member 144 in the Y direction. Specifically, slit 160*c* is disposed on the right side of protruding portion 312 a little distance away from protruding portion 312 (in the direction Y(−)). As a result, third part 148 located on the left side of slit 160*c* and second part 146 located on the right side of slit 160*b* are formed at the free end of sheet member 144 with slits 160*c* as a boundary.

Figure 10:
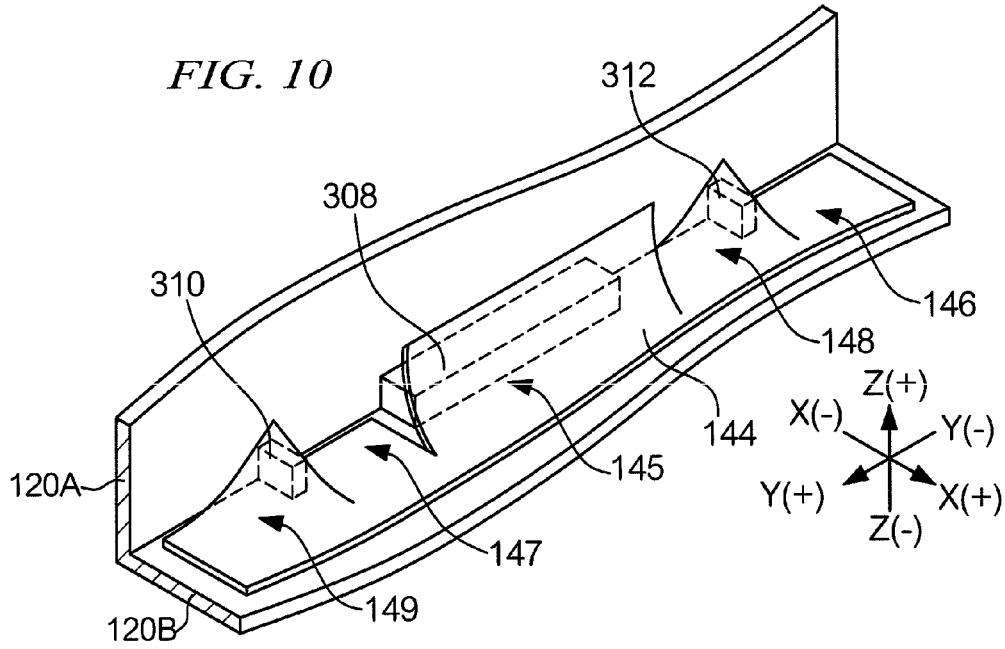
FIG. 10 shows a state of a sheet member in the base portion of the second housing chamber viewed from above at an oblique angle.
Figure 11:
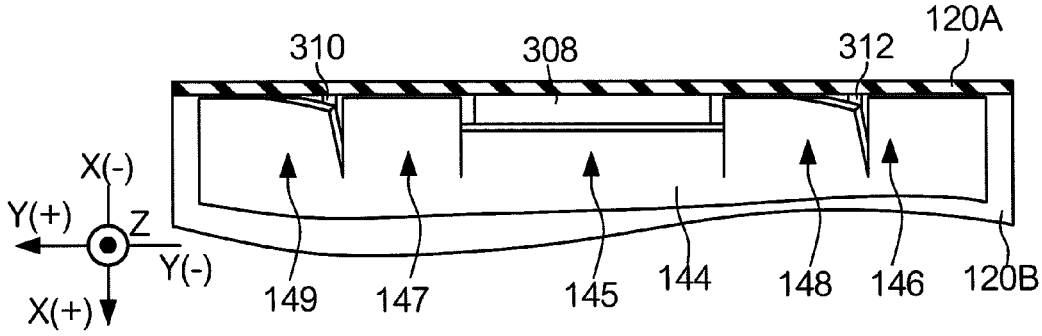
FIG. 11 shows the state of the sheet member in the base portion of the second housing chamber viewed from above.
Figure 12:
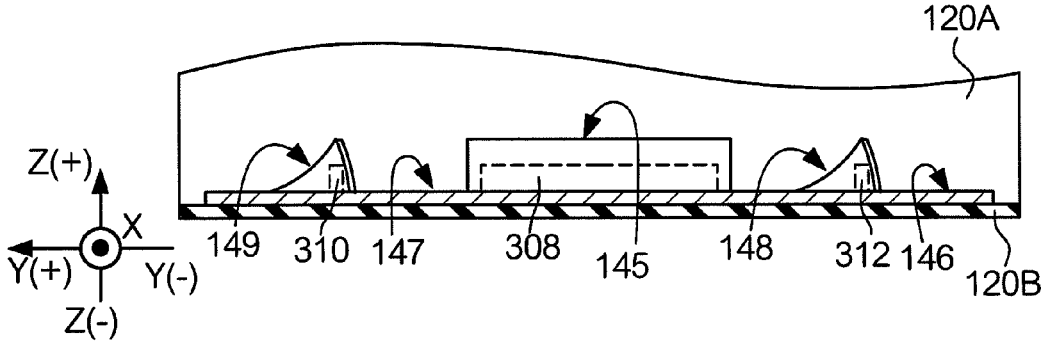
FIG. 12 shows the state of the sheet member in the base portion of the second housing chamber viewed from the front.

FIG. 10 to FIG. 12 show a state of sheet member 144 in the base portion of second housing chamber 120. FIG. 10 shows a state of sheet member 144 when the base portion of second housing chamber 120 is viewed from above at an oblique angle. FIG. 11 shows a state of sheet member 144 when bottom 120B of the base portion of second housing chamber 120 is viewed from above. FIG. 12 shows a state of sheet member 144 when wall 120A of the base portion of second housing chamber 120 is viewed from the front.

In toner-leveling mechanism 100 configured as described above, when the free end of sheet member 144 is positioned at the bottom of second housing chamber 120, first part 145 makes contact with protruding portion 308 evenly across the width of sheet member 144 (direction Y), and then bends upward evenly in the moving direction of sheet member 144 (direction X(+)) and the upward direction of gravitational force (direction Z(+)).

The right edge of third part 149 makes contact with protruding portion 310. Therefore, the right edge of third part 149 bends upward in the moving direction of sheet member 144 (direction X(+)) and the upward direction of gravitational force (direction Z(+)), and at the same time it bends upward across the width of sheet member 144 (direction Y(+)), with the result that sheet member 144 has a convexly curved portion toward the width direction of sheet member 144 (direction Y(−)). As a result, third part 149 levels toner 150 located in a space on the left side of protruding portion 310 (in the direction Y(+)) toward the moving direction of sheet member 144 (the direction X(+)) as well as toward the width direction of sheet member 144 (direction Y(−)). In other words, third part 149 brings together toner 150 located on the left side of protruding portion 310 (in the direction Y(+)) and protruding portion 310.

The right edge of third part 148 makes contact with protruding portion 312. Therefore, the right edge of third part 148 bends upward in moving direction of sheet member 144 (direction X(+)) and the upward direction of gravitational force (direction Z(+)), and at the same time it bends upward across the width of sheet member 144 (direction Y(+)), with the result that sheet member 144 has a convexly curved portion toward the width direction of the sheet member 144 (in the direction Y(−)). As a result, third part 148 levels the toner 150 located in a space on the left side of protruding portion 312 (in the direction Y(+)) toward the moving direction of sheet member 144 (in the direction X(+)) as well as across the width of sheet member 144 (in the direction Y(−)). In other words, third part 148 brings together toner 150 located on the left side of protruding portion 312 (in the direction Y(+)) and protruding portion 312.

On the other hand, because second part 147 makes contact with neither protruding portion 308 nor protruding portion 310, it does not bend upward. Therefore, second part 147 enters a space between protruding portion 308 and protruding portion 310 without being affected by protruding portion 308 or protruding portion 310, and levels the toner accumulated in the space toward the moving direction of sheet member 144 (in the direction X(+)).

In addition, because second part 146 does not make contact with protruding portion 312 nor protruding portion 310, it does not bend upward. Therefore, second part 146 enters a space on the right side of protruding portion 312 without being affected by protruding portion 312, and levels toner 150 accumulated in the space toward the moving direction of sheet member 144 (in the direction X(+)).

In addition, a weight can be provided to at least one of first part 145, second part 146, second part 147, third part 148, and third part 149. For example, rod-shaped weights extending along the edges of some of the above-described plural parts in the width direction (in the direction Y) of sheet member 144 can be fixed. Therefore, because each of the parts pushes toner 150 under a high pressure owing to the weight of the corresponding weight, toner-leveling mechanism 100 can effectively level toner 150.

As described above, because the free end of sheet member 144 has the slits corresponding to the protruding portions disposed on the bottom of second housing chamber 120, parts 145 to 149 of sheet member 144 enter the corresponding spaces lying next to the corresponding protruding portions, and toner-leveling mechanism 100 levels toner 150 accumulated in these spaces. In addition, in toner-leveling mechanism 100, because each of the slits is disposed a little distance away from the corresponding protruding portion, side edges of the free end of sheet member 144 curve upward, and toner 150 is leveled in the width direction of sheet member 144.

Although the exemplary embodiment of the present invention is described above, the invention is not limited by any of the details of the above-described example, and it is to be understood that a variety of other embodiments such as modifications of the above-described exemplary embodiment can be made within the spirit and scope of the present invention. For example, as long as a toner-leveling mechanism narrows an operation space thereof in accordance with the increase in the accumulated amount of the toner, it can have a configuration other than that of the above-described toner-leveling mechanism 100. To give a concrete example, a toner-leveling mechanism equipped with a back-and-forth motion type member, in which the member presses toner in the depth direction of the housing chamber, and an operation space of the member is narrowed in accordance with the increase in the accumulated amount of the toner, can be used.

Application of the toner-leveling mechanism according to the exemplary embodiment of the present invention is not limited to a photo conductor unit. For example, the toner-leveling mechanism according to the exemplary embodiment of the present invention can be installed not only in a housing chamber of the photo conductor unit but also can be installed in a variety of housing chambers for housing toner such as housing chambers attached to an intermediate transfer belt, a sheet conveying belt, a transfer roller and the like, and a housing chamber attached to a halfway point of a route from a toner cartridge to a developing device for temporarily housing toner to level toner accumulated in these housing chambers. In addition, application of the toner-leveling mechanism according to the exemplary embodiment of the present invention is not limited to an image-forming apparatus. The toner-leveling mechanism according to the exemplary embodiment of the present invention can be disposed in a housing chamber disposed in an apparatus other than the image-forming apparatus to level toner accumulated in the housing chamber.

Figure 13:
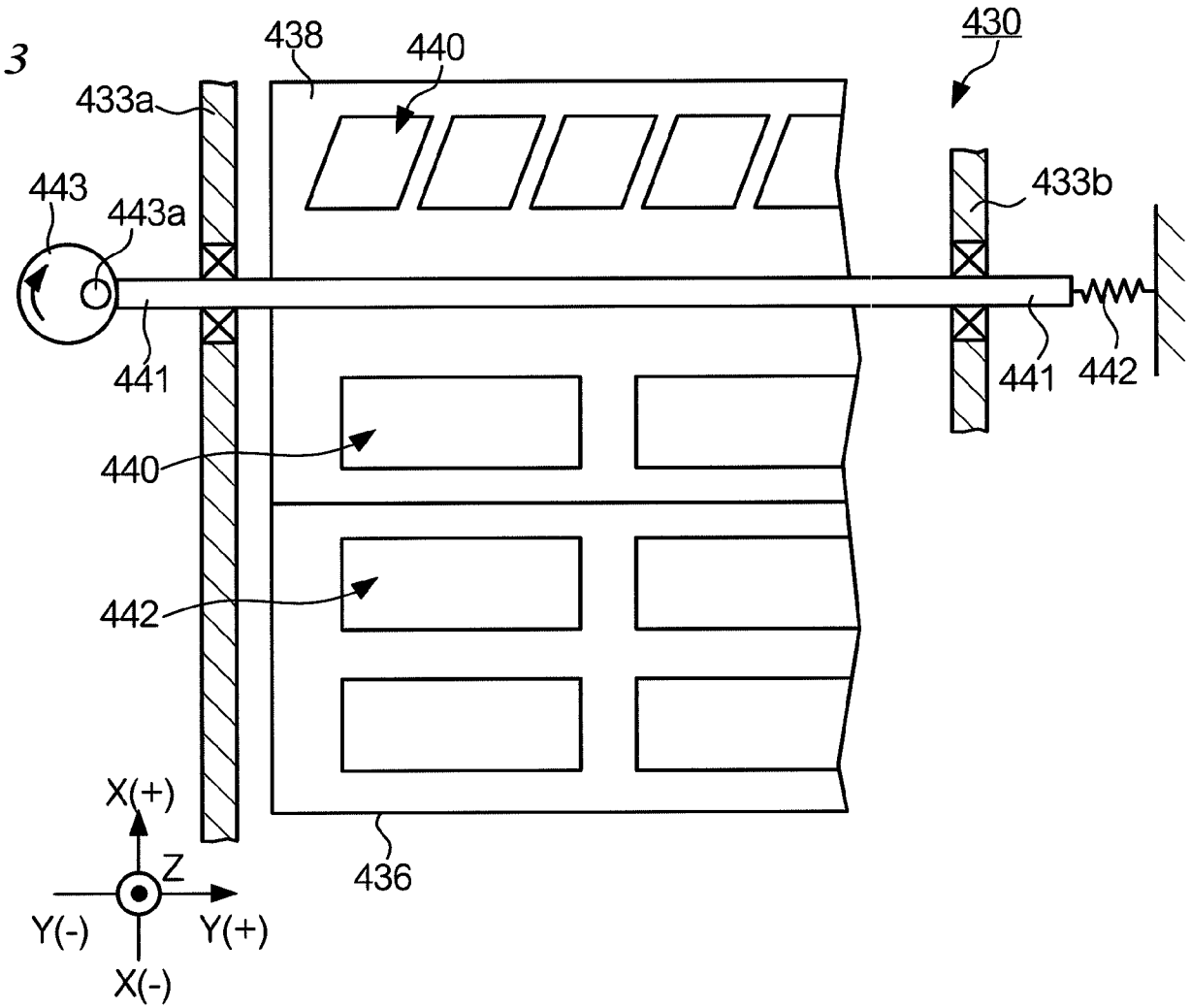
FIG. 13 shows a configuration example of the toner-leveling mechanism.

FIG. 13 shows a configuration example of toner-leveling mechanism 430. Toner-leveling mechanism 430 has a configuration different from that of the above-described toner-leveling mechanism 100, but the toner-leveling mechanisms are equivalent to each other since they both narrow their operation spaces in accordance with the increase in the accumulated amount of the toner. The toner-leveling mechanism 430 is installed in a housing chamber 400 for housing toner. This housing chamber 400 can be any type of chamber as long as it houses toner. For example, the housing chamber can be any of plural chambers in the image-forming apparatus 1 (such as housing chambers disposed near to the intermediate transfer belt, the sheet conveying belt, the transfer roller and the like).

Toner-leveling mechanism 430 has moving shaft 441 and first agitating member 438. Both ends of moving shaft 441 are supported by wall portions 433*a* and 433*b* of recovery vessel body 433 so that moving shaft 441 can move in the axial direction of moving shaft 441 (in the direction Y). One end of moving shaft 441 (an end located in the direction Y(+)) is pressed toward the other end (an end located in the direction Y(−)) of moving shaft 441 by pressure spring 442. A peripheral surface of eccentric cam 443 is in contact with the other end (the end located in the direction Y(−)) of moving shaft 441, which sets a limit to the movement of moving shaft 441 toward the other end of moving shaft 441 (in the direction Y(−)). Eccentric cam 443 is driven by a motor (not shown) and rotates with shaft 443*a* as its rotating shaft. Therefore, moving shaft 441 performs a back-and-forth movement in the axial direction of moving shaft 441 (in the direction Y).

First plate-like agitating member 438 is secured to moving shaft 441. Therefore, first agitating member 438 performs a back-and-forth movement in the axial direction of moving shaft 441 (in the direction Y) in accordance with the back-and-forth movement of moving shaft 441. First agitating member 438 has plural openings 440. When first agitating member 438 performs the back-and-forth movement in the axial direction of moving shaft 441 (in the direction Y), first agitating member 438 levels toner housed in housing chamber 400 using plural openings 440. Especially, first agitating member 438 according to this exemplary embodiment of the present invention has plural rhomboid-shaped openings 440, each of which has two parallel hypotenuses making a certain angle above the moving direction of moving shaft 441 (in the direction Y). Therefore, first agitating member 438 levels the toner not only in the moving direction of moving shaft 441 (in the direction Y), but also in the direction orthogonal to the moving direction of moving shaft 441 (in the direction X).

In addition, toner-leveling mechanism 430 has second plate-like agitating member 436. Second agitating member 436 is supported so that second agitating member 436 can move in the direction orthogonal to the moving direction of moving shaft 441 (in the direction X). Therefore, second agitating member 436 performs a back-and-forth movement in the axial direction of moving shaft 441 (in the direction Y) in accordance with the back-and-forth movement of first agitating member 438. Second agitating member 436 has plural openings 442. When second agitating member 436 performs the back-and-forth movement in the axial direction of moving shaft 441 (in the direction Y), second agitating member 436 levels the toner housed in housing chamber 400 using plural openings 442.

Second agitating member 436 is pressed in the backward direction of the depth of housing chamber 400 (in the direction X(+)) by a pressure spring and the like (not shown). As the accumulated amount of the toner in the rear of housing chamber 400 increases, second agitating member 436 is pressed in the frontward direction of the depth of housing chamber 400 (in the direction X(−)) by the accumulated toner. Therefore, second agitating member 436 moves in the frontward direction of the depth of housing chamber 400 (direction X(−)) while an area of a portion of second agitating member 436 overlapped with first agitating member 438 is increasing. In other words, the larger the accumulated amount of the toner in the rear of housing chamber 400 becomes, the more second agitating member 436 moves in the frontward direction of the depth of housing chamber 400 (direction X(−)).

As described above, toner-leveling mechanism 430 narrows an operation space thereof when second agitating member 436 moves in the frontward direction of the depth of housing chamber 400 (direction X(−)), and an area of a portion of second agitating member 436 overlapped with first agitating member 438 increases. Therefore, toner-leveling mechanism 430 levels toner without being prevented from moving by the accumulated toner. Although FIG. 13 shows that first agitating member 438 has a different structure from second agitating member 436, they can be fabricated in an all-in-one structure. In other words, first agitating member 438 and second agitating member 436 can be fabricated in such a way that they monolithically move in the direction orthogonal to the moving direction of moving shaft 441 (in the direction X). In addition, second agitating member 436 can have similar rhomboid-shaped openings to those that first agitating member 438 has In accordance with the embodiments, the toner leveling mechanism may be configured such that the mechanism is installed and operative in a housing chamber that houses toner, the toner-leveling mechanism having a rotating shaft, and a sheet member having a fixed portion attached to the rotating shaft and extending from a peripheral surface of the rotating shaft, the sheet member being configured so that part of the sheet member moves in the housing chamber while making contact with the toner in accordance with the rotation of the rotating shaft, with a result that the toner is leveled, wherein the amount of the sheet member reeled by the rotating shaft increases in accordance with the increase in the accumulated amount of the toner.

The foregoing description of the embodiments of the present invention is provided for the purposes of illustration and description. It is not intended to be exhaustive or to limit the invention to the precise forms disclosed. Obviously, a large number of possible modifications and variations will be apparent to practitioners skilled in the art. The embodiments were chosen and described in order to best explain the principles of the invention and its practical applications, thereby enabling others skilled in the art to understand the invention in various embodiments, and with the various modifications as suited to a particular use that may be contemplated. It is thus intended that the scope of the invention be defined by the following claims and their equivalents.

What is claimed is:

1. A toner-leveling mechanism installed and operative in a housing chamber that houses toner, the toner-leveling mechanism being capable of leveling toner accumulated in the housing chamber and narrowing an operation space of the toner-leveling mechanism in accordance with an increase in an accumulated amount of the toner, the toner-leveling mechanism comprises:

a rotating shaft; and a sheet member having a fixed portion attached to the rotating shaft and extending from a peripheral surface of the rotating shaft, the sheet member being configured so that part of the sheet member moves in the housing chamber while making contact with the toner in accordance with the rotation of the rotating shaft, with a result that the toner is leveled, wherein the amount of the sheet member reeled by the rotating shaft increases in accordance with the increase in the accumulated amount of the toner, resulting in an operation space of the toner-leveling mechanism being narrowed.

2. The toner-leveling mechanism according to claim 1, wherein the sheet member in the housing chamber has a portion convexly curved toward a base portion of the housing chamber where the toner is accumulated, and the sheet member pushes the toner using a top of the convexly curved portion.

3. The toner-leveling mechanism according to claim 1, wherein a free end of the sheet member has a slit corresponding to a protruding portion formed on a wall of the housing chamber; and a first part of the free end, which curves upward while maintaining contact with the protruding portion, and a second part of the free end, which enters a space next to the protruding portion without making contact with the protruding portion and levels the toner in the space, are formed with a slit as a boundary between the first part and the second part across a width of the sheet member.

4. The toner-leveling mechanism according to claim 1, wherein the free end of the sheet member has another slit to allow an edge of the free end to form a third part that maintains contact with the protruding portion and partially curves upward relative to the width of the sheet member in a direction equivalent to the axial direction of the rotating shaft.

5. The toner-leveling mechanism according to claim 1, wherein the sheet member extends from the fixed portion in the direction of rotation of the rotating shaft.

6. The toner-leveling mechanism according to claim 1, wherein the rotating shaft rotates in such a way that a moving direction of the sheet member and a direction in which a cleaning member that removes toner from a physical object at an edge of the sheet member coincide with each other at a contact zone between the cleaning member and the sheet member.

7. The toner-leveling mechanism according to claim 1, wherein polyurethane is used for the sheet member.

8. The toner-leveling mechanism according to claim 1, wherein a weight is fixed to the free end of the sheet member.

9. A photo conductor unit comprising a photo conductor drum;

a housing chamber that houses toner removed from the photo conductor drum; and a toner-leveling mechanism installed and operative in the housing chamber, the toner-leveling mechanism being capable of leveling the toner accumulated in the housing chamber and narrowing an operation space thereof in accordance with the increase in the accumulated amount of the toner, the toner-leveling mechanism comprises:

a rotating shaft; and a sheet member having a fixed portion attached to the rotating shaft and extending from a peripheral surface of the rotating shaft, the sheet member being configured so that part of the sheet member moves in the housing chamber while making contact with the toner in accordance with the rotation of the rotating shaft, with a result that the toner is leveled, wherein the amount of the sheet member reeled by the rotating shaft increases in accordance with the increase in the accumulated amount of the toner, resulting in the operation space of the toner-leveling mechanism being narrowed.

10. An image-forming apparatus comprising:

a photo conductor drum;

a charging device that exposes the photo conductor drum;

a housing chamber that houses toner removed from the photo conductor drum;

a toner-leveling mechanism installed and operative in the housing chamber, the toner-leveling mechanism being capable of leveling the toner accumulated in the housing chamber and narrowing an operation space thereof in accordance with the increase in the accumulated amount of the toner;

an exposing device that forms an electrostatic latent image; and a developing device that forms a toner image from the electrostatic latent image, the toner-leveling mechanism comprises:

a rotating shaft; and a sheet member having a fixed portion attached to the rotating shaft and extending from a peripheral surface of the rotating shaft, the sheet member being configured so that part of the sheet member moves in the housing chamber while making contact with the toner in accordance with the rotation of the rotating shaft, with a result that the toner is leveled, wherein the amount of the sheet member reeled by the rotating shaft increases in accordance with the increase in the accumulated amount of the toner, resulting in the operation space of the toner-leveling mechanism being narrowed.

* * * * *